US005925002A

United States Patent [19]

Wollman

[11] Patent Number: 5,925,002

[45] **Date of Patent: *Jul. 20, 1999**

[54] HAND-HELD VIBRATORY MASSAGER

[75] Inventor: Matt J. Wollman, Sherman Oaks, Calif.

[73] Assignee: HWE, Inc., Long Beach, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/532,968

[22] Filed: Sep. 22, 1995

[51] Int. Cl.[6] ..... A61H 23/02

[52] U.S. Cl. ..... 601/70; 601/80; 601/46

[58] Field of Search ..... 601/46, 67, 69, 601/70, 72, 73, 78, 79, 80, 82, 94, 103, 111, 130, 74, 81

[56] References Cited

U.S. PATENT DOCUMENTS

| | | | |
|---|---|---|---|
| D. 331,467 | 12/1992 | Wollman | D24/214 |
| 859,674 | 7/1907 | Lindstrom . | |
| 3,363,623 | 1/1968 | Atwell . | |
| 3,672,355 | 6/1972 | Ogawa et al. | 128/36 |
| 3,841,321 | 10/1974 | Albach et al. . | |
| 4,224,932 | 9/1980 | Farb | 128/36 |
| 4,566,442 | 1/1986 | Mabuchi et al. | 128/52 |
| 4,604,993 | 8/1986 | Moriwaki et al. | 128/24.2 |
| 4,632,095 | 12/1986 | Libin | 128/67 |
| 4,825,853 | 5/1989 | Iwamoto et al. | 128/36 |
| 4,846,158 | 7/1989 | Teranishi | 128/36 |
| 4,958,628 | 9/1990 | Iwamoto et al. | 128/36 |
| 5,181,504 | 1/1993 | Ono et al. . | |
| 5,193,528 | 3/1993 | Iwamoto et al. | 601/73 X |
| 5,336,159 | 8/1994 | Cheng | 601/73 X |
| 5,437,607 | 8/1995 | Taylor | 601/49 |

FOREIGN PATENT DOCUMENTS

| | | | |
|---|---|---|---|
| 3316100 | 11/1984 | Germany | 601/70 |

OTHER PUBLICATIONS

Brochure entitled "Use and Care of The Cordless Power Node Model: AV 6002" Photographs, numbered 1–11, of Cordless power Node Model AV 6002, 1995.

*Primary Examiner*—Danton D. DeMille
*Attorney, Agent, or Firm*—Christie, Parker & Hale, LLP

[57] ABSTRACT

A hand-held massager includes an elongated handle, a contoured first massaging member or massaging head resiliently coupled to the handle, and at least one other massaging member or node mounted on the massaging head for providing an intense localized massage. The hand-held massager further includes a plurality of vibration inducing elements. A first vibration inducing element includes a main motor housed substantially within the handle is linked to a drive shaft extending from the motor into the massaging head. A massaging head eccentric cam is connected to the drive shaft within the massaging head for generally vibrating the massaging head and node relative to the handle upon rotation of the drive shaft. A second vibration inducing element includes a second motor or submotor linked to an output shaft. A second eccentric cam located substantially within the node extends from the output shaft for primarily vibrating the node upon rotation of the drive shaft. Other vibration inducing elements can be provided to vibrate additional vibratory members. Separate controls coupled to each vibration inducing element allow for independent control of each motor and the vibration induced in each massaging member. In operation, a user can adjust the relative phases of the motors to provide a wide variety of massage sensations.

14 Claims, 5 Drawing Sheets

HAND-HELD VIBRATORY MASSAGER

FIELD OF THE INVENTION

The present invention relates to personal massaging devices and, more particularly, to a hand-held vibratory massager containing a plurality of massaging members and a plurality of independently controllable vibratory sources for adjusting the level of vibration of the massaging members.

BACKGROUND OF THE INVENTION

A number of hand-held vibratory massagers are known in the art. These massagers typically include an elongated handle coupled to a massaging head. A single source of vibration vibrates the massaging head by rotating an eccentric flyweight or cam mounted within the head. While these types of massagers are suitable for providing a relaxing vibratory massage sensation, the massagers are limited in the types of sensations they can induce.

To enable various types of massage sensations, some hand-held vibratory massagers include shaped heads. For example, U.S. Pat. No. 4,958,628 to Iwamoto et al. discloses a massager including a head having ribbed side faces for enabling a tapping massage. U.S. Pat. No. 4,604,993 to Moriwaki et al. discloses a massager with a head having a flat rubbing massage top surface and a curved tapping massage side surface. U.S. Pat. No. 4,848,156 to Teranishi discloses a massager having a head containing small outwardly pointed projections on one face. Although helpful in allowing for varying massage sensations, these single motor massagers are still limited in the degree and type of vibration they can provide at the point of contact between the shaped portions and the user's body.

U.S. Pat. Des. 331,467, commonly owned by the owner of the present application, discloses another single motor massager with a shaped head. This massager includes a substantially spherical massaging head having a nipple-shaped side face for producing a finger-like massage at a localized area of a user's body. The outward appearance of this massager is similar to that of the present invention. However, the prior art massager contains only a single source of vibration for vibrating the entire head, including its nipple-shaped side face. The single source of vibration is a motor housed in the handle coupled to an eccentric cam located within the massaging head. Users would prefer a massager that is capable of producing a wide variety of massage sensations, including, for example, intense massage sensations proximate the point of contact of the massaging head to the user's body.

SUMMARY OF THE INVENTION

The present invention provides a hand-held vibratory massager that can be used to induce a wide variety of massage sensations through the use of multiple sources of vibration or vibration inducing elements. In a presently preferred embodiment, the massager includes an elongated handle, a first massaging member or massaging head resiliently coupled to the handle, and a second massaging member, or node, mounted on the second massaging member. A first source of vibration includes a first motor connected to a drive shaft which extends from the first motor. Within the massaging head, an eccentric cam is connected to the drive shaft. When the first motor is activated, the drive shaft rotates the eccentric cam, thereby unbalancing the eccentric cam and inducing generalized vibration of the first and second massaging members. The massager also includes a second source of vibration including a second motor with an output shaft connected to a second eccentric cam for inducing vibration primarily within the second massaging member. In an alternate embodiment, a single motor is coupled to a pair of drive mechanisms, one for inducing vibration in the massaging head, and another for inducing vibration within the node.

In the preferred embodiment, through separate controls for each vibration inducing element, the present invention allows the user to adjust the level of vibration in the head and the node to produce a wide variety of massage sensations When only the first motor is activated, both the head and the node attached to the head generally vibrate with respect to the handle. When only the second motor is activated, the node primarily vibrates and provides concentrated vibration at the point of contact with the user's body. When both motors are simultaneously activated, the combined vibrations caused by the plurality of motors create a wave-like effect that can be varied through the controls to enable a wide variety of massage sensations. Depending on whether the motors are controlled to cause vibration in-phase or out-of phase, the sensations induced can include a repeated patting sensation, a smooth rolling motion, an intense vibratory sensation at the node, or other sensations.

BRIEF DESCRIPTION OF THE DRAWINGS

The present invention will be better understood with reference to the following detailed description of a presently preferred embodiment, when viewed in conjunction with the accompanying drawings, in which FIG . 1 is a side elevational view of the hand-held massager according to the present invention.

DETAILED DESCRIPTION

Figure 1:
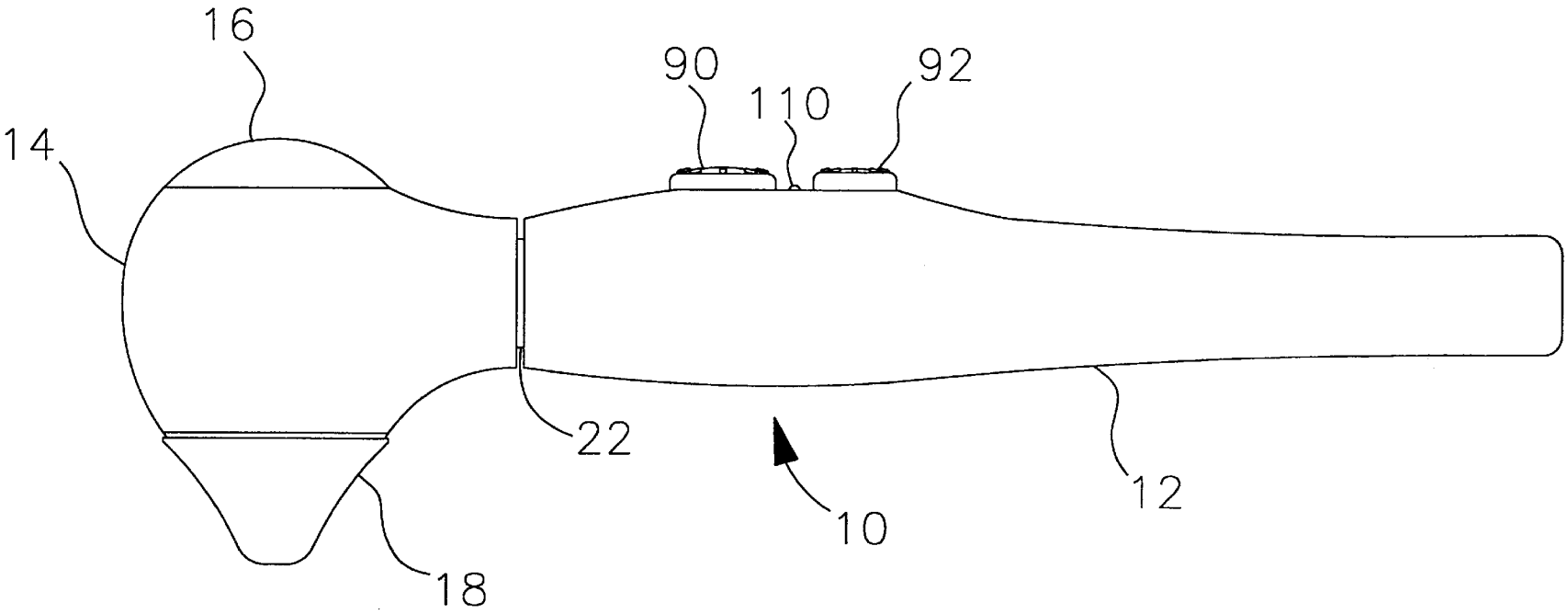

Referring to FIG. 1, a hand-held massager 10 according to a presently preferred embodiment of the present invention includes an elongated tapered handle 12 resiliently coupled to a roughly spherical-shaped first massaging member or massaging head 14. The massaging head may include one or more contoured sections 16 for providing a vibratory massage to a user. A second massaging member, or node 18, is coupled to a section of the massaging head along an axis perpendicular to the longitudinal axis of the handle. The node is roughly nipple-shaped for providing an intense finger-like massage to localized areas of the user's body. Other geometric couplings of the node to the head are possible.

Figure 2:
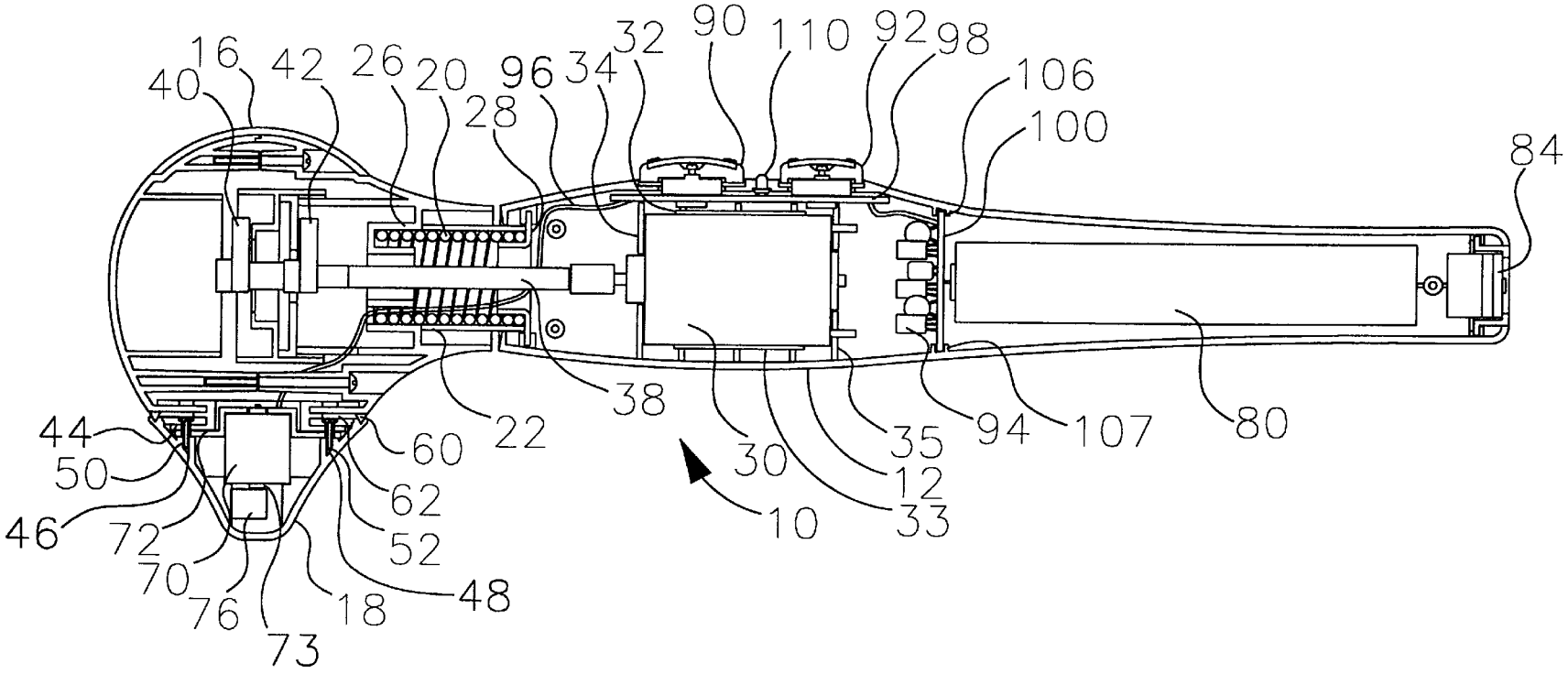
FIG. 2 is a cross-sectional view of the hand-held massager shown in FIG. 1.

Referring to FIG. 2, the handle is resiliently coupled to the massaging head through a tightly coiled spring 20 employed in a neck portion 22 of the massager between the handle and the head. The spring is constrained by a hub 26 in the massaging head and a spring support member 28 adjacent the neck within the handle. In operation, the spring allows for vibration of the head relative to the handle.

The handle has a hollow interior which houses a first rotary motor, or main motor 30, for generally vibrating the massaging head and node. The main motor is snugly mounted between main motor housing members 32, 33, 34, 35 molded within the handle. The main motor is connected to one end of a drive shaft 38, which extends coaxially through the handle and neck and into the head. The drive shaft connects the main motor to a pair of eccentric cams 40, 42 connected proximate to the end of the drive shaft within the massaging head. The first motor and associated drive mechanism and cams constitute in the preferred embodiment, a first vibration inducing element. In operation, the motor turns the drive shaft and unbalances the massaging head through rotation of the eccentric cams, thereby resulting in vibration of the head and the node. Although housed in the handle in a presently preferred embodiment, the first motor may be housed in other areas as well, for example, within the massaging head itself.

The node is connected to the massaging head through a rubber gasket 44 connected to the head and the node. The rubber gasket, screwed into notches 46, 48 by screws 50, 52, allows limited movement of the node relative to the massaging head. The node may also be connected in other ways, for example, by way of a spring (not shown). An O-ring 60 placed within a recess 62 between the head and node prevents hairs or other objects from becoming lodged in the recess. The O-ring is preferably contoured to make flush the adjacent surfaces of the massaging head and node.

In a preferred embodiment of the present invention, a second rotary motor, or submotor 70, is housed substantially within the node to vibrate the node independently of the vibration induced in the massaging head by the main motor. The submotor, mounted on a submotor housing 72, includes an output shaft 73. A single eccentric cam 76 is connected to the output shaft in the node. In operation, the submotor rotates the eccentric cam and unbalances the node, resulting in localized vibration primarily within the node. The submotor does not have to be housed within the node. It may, for example, be housed within the massaging head or the handle. If housed within the handle, the submotor can be vibrationally coupled to the node using, for example, bevel gears and intersecting shaft axes. In the preferred embodiment, the second motor and associated output shaft and cams for primarily vibrating the node constitute a second vibration inducing element.

In the preferred embodiment, the motors are powered by a rechargeable nickel cadmium battery 80 housed within the handle. A plug 84 for AC charging of the rechargeable battery is provided at the end of the handle opposite the massaging head. By using the charged battery to power the massager, the massager becomes cordless, thus allowing for unincumbered movement of the massager to various areas of the user's body. Alternatively, a power cord (not shown) can be connected to the plug for providing direct power to the massager.

Figure 3:
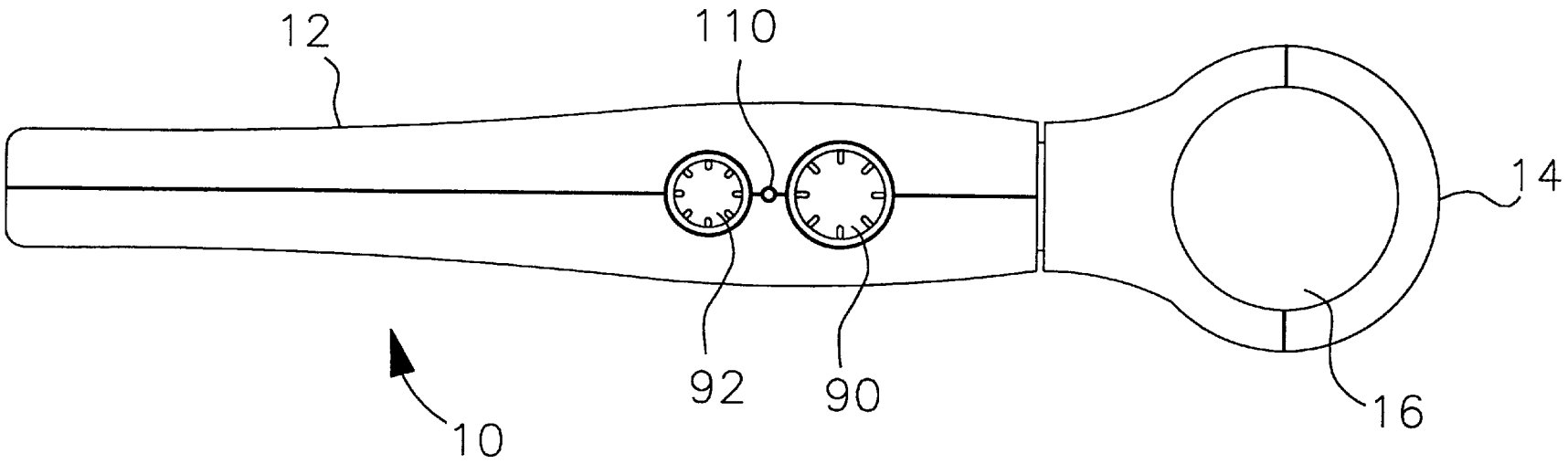
FIG. 3 is a top plan view of the hand-held massager.

Referring also to FIGS. 2 and 3, a main motor control switch, or knob, 90 and a submotor control switch, or knob, 92 are provided, partially recessed within the surface of the handle, for adjusting the amount of vibration induced in the massaging head and node, respectively. The switches are coupled to a conventional electric circuit 94 for regulating the amount of current or power delivered from the power source to each motor. A wire 96 extends through the neck and massaging head for delivering current to the submotor. The switches and circuit components are preferably mounted on printed circuit boards 98, 100 fixedly attached to main motor housing member 32 and circuit support notches 106, 107, respectively. In the preferred embodiment an LED indicator light 110 on the surface of the handle indicates that the rechargeable battery is being charged.

Figure 4:
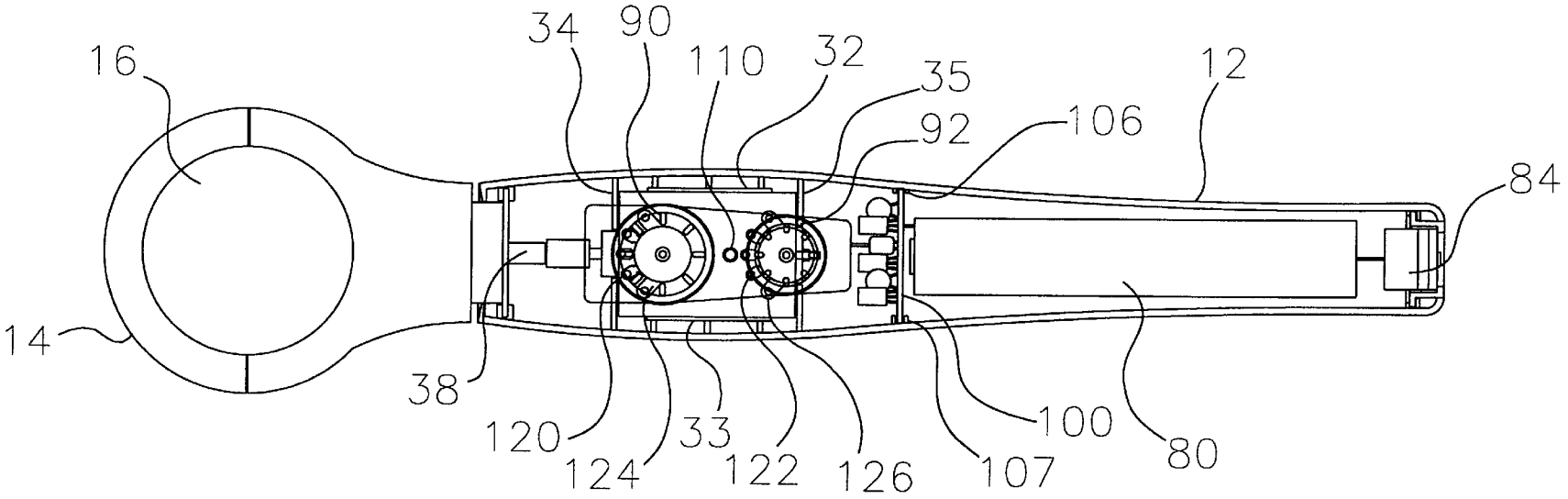
FIG. 4 is a top plan view partly in cross-section, of the massager.

Referring to FIG. 4, the rotary control switches include a series of electrical contacts 120, 122 for enabling varying amounts of current to each motor. In operation, as each knob is turned away from the off position, a connection is made between the power source and motor through one of the contacts. Each contact has a varying amount of resistance, thereby regulating the level of current delivered to each motor.

Figure 5:
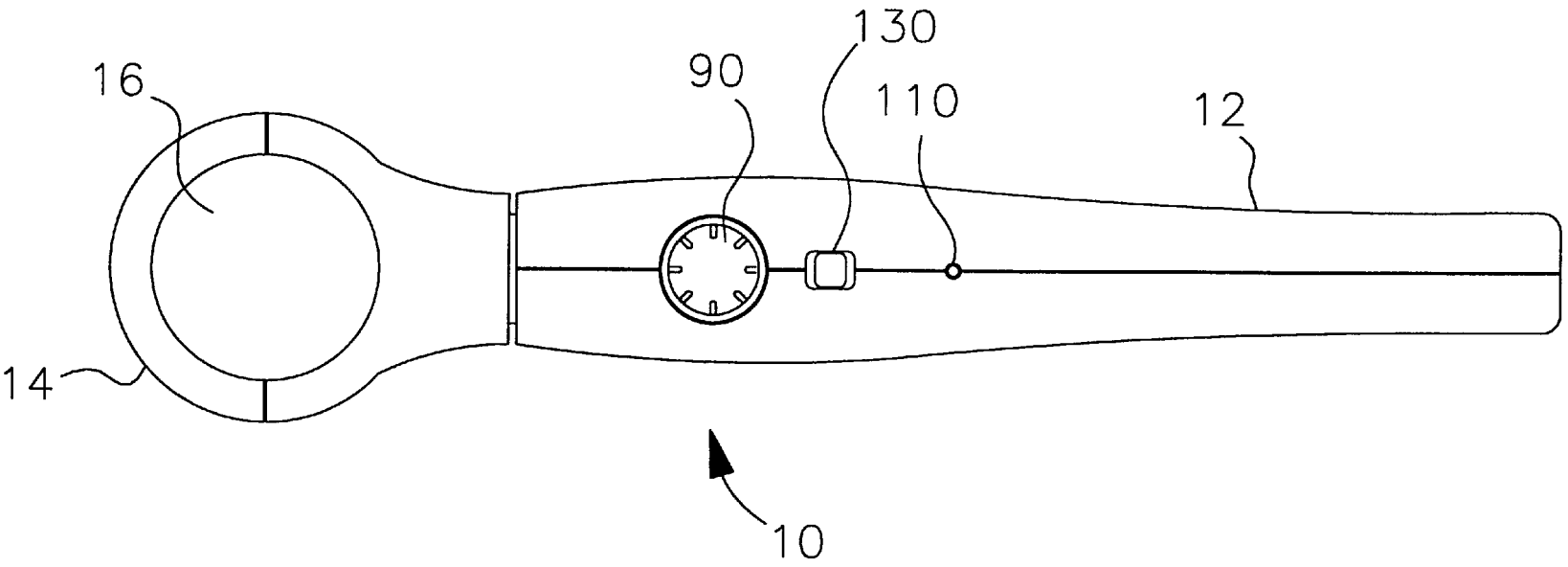
FIG. 5 is a top plan view of an alternate embodiment of the present invention

Referring to FIG. 5, in an alternate embodiment of the invention, the rotary submotor control switch is replaced by a tri-state switch 138 for turning the submotor off or operating it at low or high vibration inducing levels.

Through manipulation of the levels of vibration induced in the massaging head and node, the hand-held massager produces a variety of different massage effects and creates an array of physical sensations in the user. For example, if the main motor control switch is on and the submotor control switch is off, the massaging head and node will synchronously vibrate. On the other hand, if the main motor control is off and the submotor control switch is on, the massaging sensation will be primarily directed within the node, resulting in a intense finger-like massage. In each case, the degree of vibration of each motor may be adjusted as desired. When both controls are enabled, a wide variety of wave-like sensations can be induced by coordinating the relative vibrations of the head and the node. The combined action of the motors provides a modulating wave effect that is relaxing to the user. At other degrees of adjustment, the node and head vibrate either in-phase or out of phase and induce different massage effects. Any permutation of the speeds of the respective motors results in a different phase-shift phenomenon that may provide a different sensation to the user.

With the present invention, a user is able to induce a continuum of sensations varying from a general patting sensation to a tapping or rubbing sensation by adjusting the degree of vibration induced in each massaging element. These sensations include, for example, percussive, tapping, and rolling sensations and other rhythmic sensations created by the combined action of the multiple vibration inducing elements. In certain modes, sensations may be induced that include a feeling of an imaginary third vibration inducing element between the first and second vibration inducing elements.

Although described in terms of a presently preferred embodiment, those skilled in the art will readily appreciate that the present invention as set forth in the following claims is not limited to the embodiment described. Broadly, the present invention involves the use of a plurality of sources of vibration or vibration inducing elements to induce a variety of massage sensations. In an alternate embodiment, a single motor may be coupled to drive mechanisms that allow vibration to be induced in more than one location on the massager. For example, a single motor can be connected to two separate drive mechanisms, one for vibrating the head and the other for vibrating the node. In another variation, a massager according to the present invention may include more than two vibration inducing elements to create additional massage effects by the combined vibration of one or more motors. The motors may be housed in any suitable location either within the handle, within either or both of the massaging members, or in any combination thereof. The shape of the massaging members can be varied to induce particular massaging effects. In still another variation, the massaging members may be integrally or resiliently connected to the handle or to one or more of the other massaging members.

What is claimed is:

1. A hand-held massager comprising:

an elongated handle;

a first massaging member resiliently coupled to the handle;

a first motor;

a drive shaft having first and second ends, the first end being connected to the first motor;

first massaging member unbalancing means connected proximate to the second end of the drive shaft substantially within the first massaging member for vibrating the first massaging member upon rotation of the drive shaft;

a second massaging member connected to the primary massaging member;

a second motor having an output shaft; and second massaging member unbalancing means connected to the output shaft substantially within the second massaging member for vibrating the second massaging member upon rotation of the output shaft.

2. The hand-held massager of claim 1 further comprising first control means coupled to the first motor for adjusting the level of vibration of the first massaging member, and second control means coupled to the second motor for adjusting the level of vibration of the second massaging member.

3. The hand-held massager of claim 1 wherein the first massaging member is substantially spherical.

4. The hand-held massager of claim 1 wherein the second massaging member is substantially nipple-shaped.

5. The hand-held massager of claim 1 wherein the first motor is housed substantially within the handle.

6. The hand-held massager of claim 1 wherein the second motor is housed substantially within the second massaging member.

7. The hand-held massager of claim 1 further comprising a rechargeable power source housed within the handle for providing power for the first and second motors.

8. The hand-held massager of claim 1 further comprising a coil spring located between the handle and the first massaging member.

9. A hand-held massager comprising:

a handle having first and second ends;

a massaging head mounted to the first end of the handle;

a resilient coupling between the massaging head and the handle for allowing movement of the massaging head relative to the handle;

a main vibration inducing element including:

a main motor housed substantially within the handle;

a drive shaft connected to the motor, the drive shaft extending from the main motor through the resilient coupling and into the massaging head; and a massaging head eccentric cam connected to the drive shaft proximate the second end of the drive shaft for vibrating the massaging head upon rotation of the drive shaft;

a node massaging member coupled to the massaging head; and a second vibration inducing element including:

submotor having an output shaft, the submotor being housed substantially within the node massaging member; and a node eccentric cam connected to the output shaft within the node massaging member for primarily vibrating the node upon rotation of the output shaft.

10. The hand-held massager of claim 9 further comprising a main motor control switch for adjusting the rate of rotation of the drive shaft.

11. The hand-held massager of claim 9 further comprising a submotor control switch for adjusting the rate of rotation of the output shaft.

12. The hand-held massager of claim 9 wherein the massaging head includes a contoured portion.

13. The hand-held massager of claim 9 wherein the node is substantially nipple-shaped for providing a localized massage.

14. The hand-held massager of claim 9 further comprising a power supply mounted within the handle for providing power to the main motor and submotor.

* * * * *